United States Patent [19]

Lodispoto

[11] Patent Number: 4,681,114

[45] Date of Patent: Jul. 21, 1987

[54] WOODEN-SHOE TO TREAT HYPERLORDOSIS AND LIPODYSTROPHIA LOCATED IN THE THIGHS AND GLUTEI

[75] Inventor: Alberto Lodispoto, Rome, Italy

[73] Assignees: Luigi Minonzio; Giovanni Verzilli, both of Rome, Italy; a part interest to each

[21] Appl. No.: 689,576

[22] Filed: Jan. 7, 1985

[30] Foreign Application Priority Data

Dec. 14, 1984 [EP] European Pat. Off. ..... 84830340.0

[51] Int. Cl.[4] ..... A61F 5/14

[52] U.S. Cl. ..... 128/581; 36/91; 36/11.5

[58] Field of Search ..... 128/581, 583, 584, 585; 36/83, 91, 11.5

[56] References Cited

U.S. PATENT DOCUMENTS

| | | | |
|---|---|---|---|
| 1,731,225 | 10/1929 | Schneider | 128/581 |
| 2,518,649 | 8/1950 | Tydings et al. | 128/585 |
| 3,305,947 | 2/1967 | Kalsoy | 36/91 |
| 3,964,181 | 6/1976 | Holcombe, Jr. | 36/91 |
| 4,258,480 | 3/1981 | Famolare, Jr. | 36/91 |
| 4,425,721 | 1/1984 | Spronken | 36/11.5 |

OTHER PUBLICATIONS

Kalso Systemet, Inc., The Story of the Earth Negative Heel Shoe, 1974.

*Primary Examiner*—Richard J. Apley
*Assistant Examiner*—H. Macey
*Attorney, Agent, or Firm*—Jacobs & Jacobs

[57] ABSTRACT

A wooden-shoe to treat hyperlordosis and lipodystrophia comprising: a top member (21) the upper surface of which has generally an orthopedic shape and serves to rest directly thereon the sole of the foot of the user, while under surface (26) is substantially flat and provided with short front and back end stretches (28, 28'), respectively, which are light bent upwards; a bottom member (22) forming the sole of this shoe and so shaped that its upper surface (25) fits together with the solidly connected under surface (25) of top member (21) of wooden-shoe (20), while its under surface has an intermediate substantially flat portion extended from a short light bent upwards rear stretch (30) to the so-called front metatarsal arc (29) and proceeds then forwards up to the tip of the wooden-shoe forming a gradually increasing rise from said front metatarsal arc (29) to tip (31) in respect to the deambulation plan (s) of the wooden-shoe (20), through the front end stretch (**30*a***) of the shoe, which is highly arcuated upwards.

11 Claims, 5 Drawing Figures

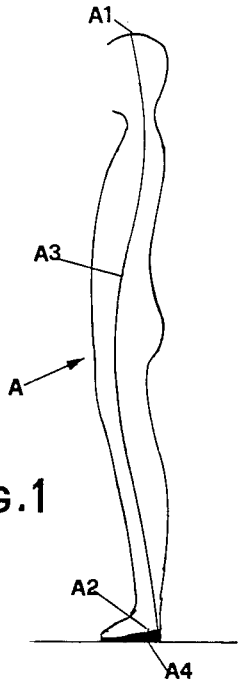
FIG. 1
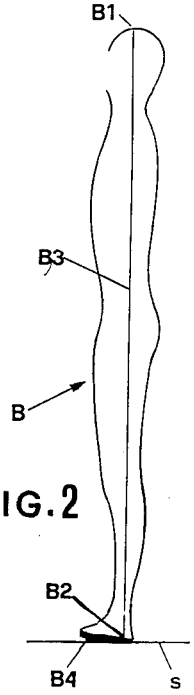
FIG. 2
FIG. 3
PRIOR ART
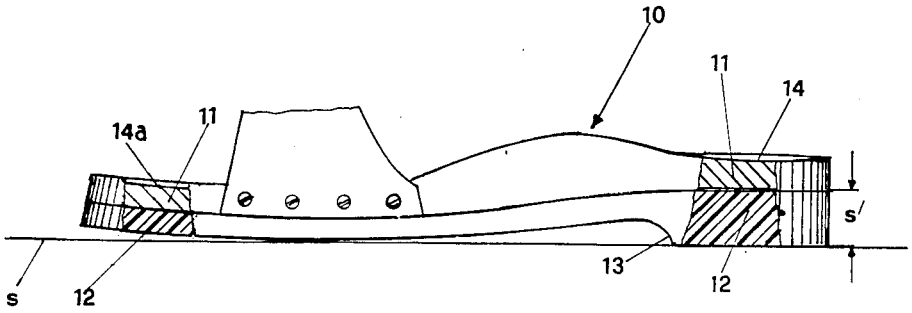

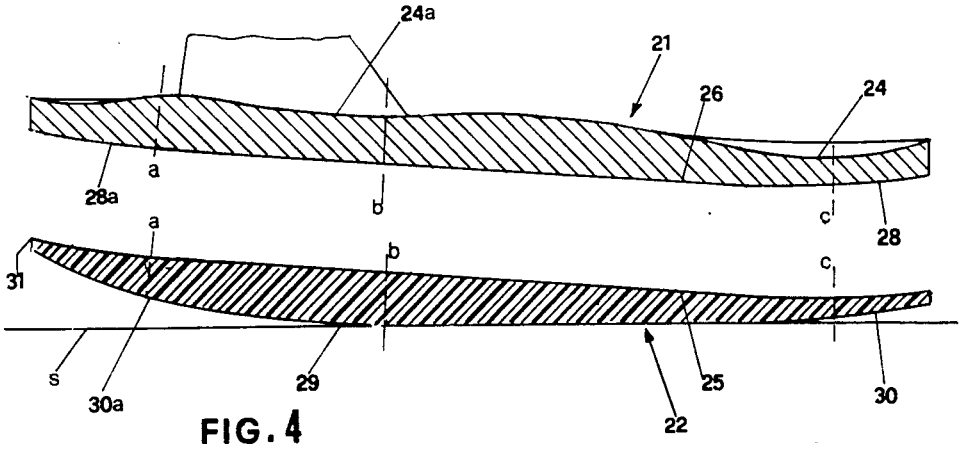
FIG. 4
FIG. 5
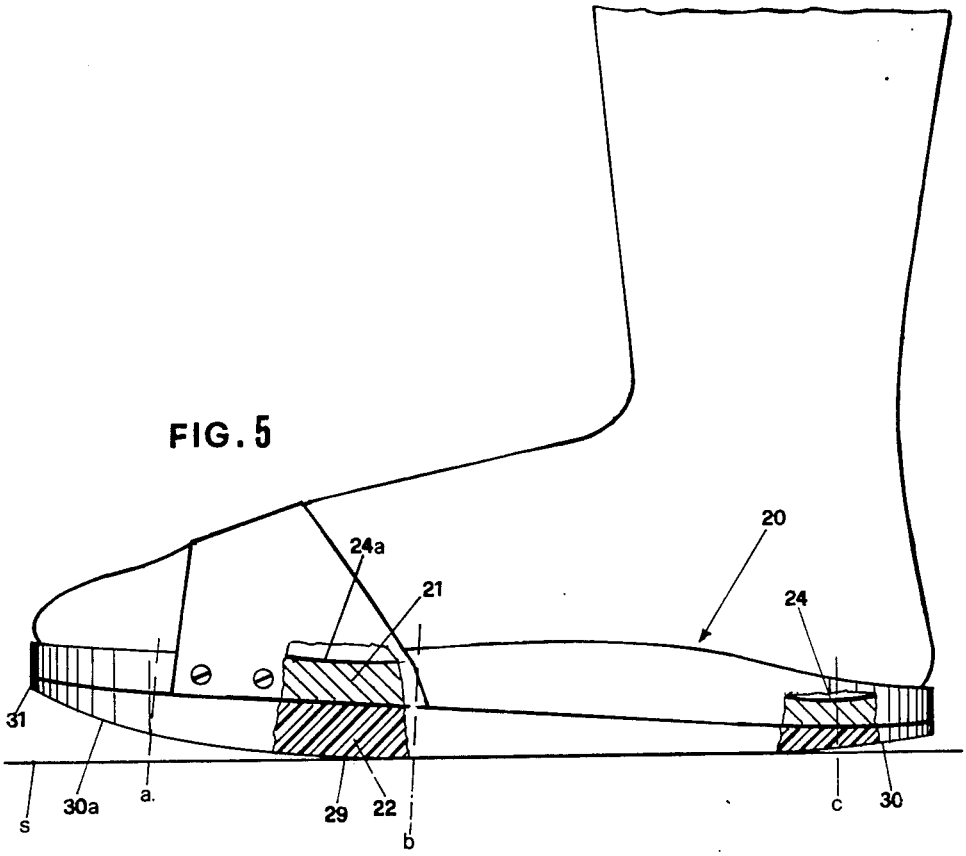

WOODEN-SHOE TO TREAT HYPERLORDOSIS AND LIPODYSTROPHIA LOCATED IN THE THIGHS AND GLUTEI

The invention relates to a wooden-shoe or sandal which is is particularly shaped in its section from the sole of the foot of the user and the plane of deambulation, and more precisely a wooden-shoe or sandal the main scope of which is to treat hyperlordosis and lipodystrophia located in the thighs and glutei. This is carried out by varying the space between the sole of the foot and the deambulation plane through a proper gradually increase rise from the back to the front portion of such a wooden-shoe. The actual shape of this gradually increasing rise and the maximum value of the same depends on the height of the person and size of the conventional shoe usually worn by same, as well as on the planned therapy to be followed for treating hyperlordosis and lipodystrophia of the subject.

In the last years the generic word "cellulitis" has spread, particularly for that state of disharmonic distribution of the adipic masses located in the flanks, thighs and gutei, leading to studies concerning the causes of same, as well as to suggestions and realizations to eliminate or attenuate such a distribution. In the female, the young or even very young may be particularly affected giving them an ungraceful posture even if they are slim. The studies and different these concerning "cellulitis" have not led to sound suggestions as regards therapies having effective results. At present, several therapies are then suggested: from physiotherapy to hormones, from massage to diffusion agents, from diet to psychotherapy, from the laser to mesotherapy. Furthermore, an indeterminable number of local applications is provided, e.g. baths, creams, unguents, liquids, etc.

Because of his professional activity, the Applicant has successfully treated several cases of cellulitis and deduced first of all that:

(a) it affects nearly exclusively the female sex;

(b) it is localized prevalently at the flanks and glutei.

As regards remark (a) it seems that the hormone constellation of the women (with a prevalence of female hormones: estrin, progesterone) is responsible for the cellulitic infiltrations. As regards the remark (b) this is to be related to the fact that an organ, a tissue which is not stressed, or a function which is not carried on, atrophies or degenerates. Glutei and thighs are exposed to a fat and cellulitic degeneration when they are not employed, and this may even happen in women who carry on sporting activities. It could be considered an absurdity to admit that muscles so important and compelling for the posture and deambulation may actually not be stressed even during a sporting practice, but nevertheless I believe that this is true.

A practical demonstration may be made by placing a subject in an upright position in front of a mirror, with the feet slightly apart and arms hanging freely at the sides of the body. When placed in such a position, the ideal line of the load of the human body must start from the apex of the head and proceed along the ears, neck, shoulders, arms and ideally extend from the tip of middle finger down to the ground. When such a load line is normal, the arrival point relating to each arm will be lateral to the respective foot, in the central area of same, while by an abnormal condition the arrival point will be towards the tip of the foot or tilting forward.

When the load line is abnormal, a accentuation of the normal bending of the spinal column, that is to say a lumbar hyperlordosis with a remarkable prominence of the abdomen almost protruding forward is evidenced. If the subject remains in that position it is then possible to note that by touching deeply the muscular masses of the gluteal region they are flabby, flat, relaxed not only by staying in position, but also when a movement is made by raising up one knee and then the other, as such a movement does not cause any contraction of these muscular masses.

To study the cellulitic localizations at the thighs and glutei and deduce suggestions of possible therapies suitable for corrections and/or cures, the Applicant has particularly induced the patients kept under his observation to contract, in an upright position, the abdominal muscles and straighten the spinal column by tightening the muscles of the back. In this forced position and condition of severe muscular tension, the cited arrival point of an ideal extension of load line resulted for each patient inside the central area of the foot, and the muscles of glutei and thighs resulted in a contracted condition not only when the patient was still in such position, but also when a deambulation movement was imitated by alternately raising one foot and then the other. women have the body barycentre displaced forwards, either when they are still in an upright position and by walking or practing sport, and they use the muscles of the front region of the thighs, which in effect which are proportionally more lean, while the muscles of the glutei and those of the posterolateral region of the thighs are little used or not used and degenerate into fat and cellulitis. This displacement of the barycentre forwards may be hereditary and transmitted from the mother to daughter, but it is more often due to the use of high heels, particularly when the user is very young. To avoid the displacement forwards the young body emphasizes the lumbar plexure, the abdomen becomes prominent, glutei lose their static and dynamic function and this ultimately leads to the problems discussed above.

To compensate what is badly-made and find, within possible limits, a remedy for the pathology in progress, three therapeutic instrumentations are suggested, and precisely:

1. By standing or walking, correct continuously the position of the body, imagining to push the head upwards—without lifting, however, the chin or putting oneself on the tips of one's toes—and thus correct the hyperlordosis;

2. Practice several times a day physical exercises to strengthen the abdominal muscles;

2. Cause—as much as possible and with a suitable intermittance—the displacement of the body barycentre backwards, either by standing and walking, after having worn suitable wooden-shoes or sandals provided with a front heel-rise.

While as concerns the therapeutic instrumentations 1 and 2 it is possible to trust only to the availability and will of the patient. For the therapeutic instrumentation 3 it is obviously necessary to have at one's disposal suitable wooden-shoes or sandals to be worn in order for providing such displacement of the body barycentre.

The invention as claimed is intended to remedy these faults of the present technique as regards the therapy to treat hyperlordosis and lipodystrophia.

The advantages offered by the invention consist substantially in providing a means which is simple and has a low cost of production, namely a wooden-shoe or sandal the sole of which has its front end portion arcuated upwards to a large degree to form a gradually increasing rise from the so-called metatarsal arc to the tip of this wooden-shoe with respect to the deambulation plane. Such a front rise is in sharp contrast with the back heel-rise of a conventional shoe provided with a heel, this latter being often high or even very high particularly for female shoes.

The present invention is illustrated in terms of a preferred embodiment in the accompanying drawings, wherein:

FIG. 1 is a schematic side elevation view of a human body to evidence a load line showing hyperlordosis;

FIG. 2 is a schematic side elevation view like FIG. 1, however showing an ideal substantially rectilinear load line, the scope of which is to represent a human body without hyperlordosis and lipodystrophia, when wooden-shoes or sandals according to the invention are used for the therapy;

FIG. 3 is an elevation, partially sectioned view of the left side of a left wooden-shoe according to one of the several types manufactured at the present time, such a wooden-shoe being provided with a conventional back heel of a modest height;

FIG. 4 is an elevation, partially sectioned exploded view of a wooden-shoe according to the principles of this invention;

FIG. 5 is an elevation view of the wooden-shoe depicted in FIG. 4, wherein the component members are solidly assembled as it is necessary for the use of such wooden-shoe, the foot with the end part of the leg being also shown schematically when the human body is in the upright position.

Turning now to the drawings and first of all to FIGS. 1 and 2, it may be seen that a wooden-shoe is worn by a human body A. Wooden-shoe A4 is believed to cause hyperlordosis according to the load line from apex A1 of the head to the bottom end A2. Due to the hyperlordosis, the prominence of the barycentre of body A, which is displaced forwards can be readily seen.

Body B of FIG. 2 has an ideally rectilinear, vertical load line B1–B2. This ideal position is the goal to be achieved from habitual use of the wooden-shoe or sandal B4 shaped according to the principles of this invention, which is intended to bring backwards the barycentre of body B, so that the vertical line of gravity may reach the junction line of the foot centres at its bottom end.

The wooden-shoe of the invention schematically shown in FIG. 2 is suitable to correct hyperlordosis and treat lipodystrophia because of its main characteristic relating to the shape, wherein a gradually increasing rise is provided at the front portion of the shoe. According to one embodiment of the invention, this corrective wooden-shoe could be provided as a single member, preferably of wood, the upper surface of which has, in turn, an orthopedic shape to better support thereon the sole of the foot of the user.

To better explain the principles of the invention and show some other embodiments, such main characteristic has been carried out by using a wooden-shoe comprising two superposed component members.

FIG. 3 shows a prior art wooden-shoe comprising a top member 11, generally of wood, and a sole member 12 solidly connected to the under surface of top member 11. As an example only, sole 12 has been provided with a heel 13 having a modest height s'. In FIG. 3, sole 12 is made of synthetic resin, as is conventional.

The upper surface of the wooden-shoe 10 extends from the back end 14 to the front end 14*a*. Such a surface has often an orthopedic shape (not shown) to better support the foot of the user. It is however important to note that the level of back support 14 is higher than front support 14*a*, with respect to the deambulation plane s.

It is believed that the higher level of back support 14 with respect to front support 14*a* will be disadvantageous for the user who is already drawn toward hyperlordosis, either because of heredity or repeated use of high heel shoes.

According to FIG. 4, wherein two component members 21, 22 are shown in a spaced position, it may be seen that the substantially flat lower surface 26 of top member 21 is inclined upwards from the back to the front portion of wooden-shoe 20, when the substantially flat portion of the lower surface of bottom member 22, i.e. from the back end 30 to the so-called front metatarsal arc 29, is resting on the deambulation plane s. As shown, the back end portion 30 of bottom member 22 is slightly arcuated upwards. Furthermore, the inclination of lower surface 26 of top member 21 is seen when the two component members 21 and 22 of wooden-shoe 20 are solidly connected to each other as shown in FIG. 5, wherein a portion the user's foot are also shown.

The lower member 22 which forms the sole of wooden-shoe 20 must be so shaped that it not only provides a gradually increasing frontal rise, instead of a back heel, but also allows a remarkable bascule or see-saw movement of the user's body when walking, this latter being really important and helpful to carry out the desired effect through the use of the wooden-shoe of the invention.

The exploded view of FIG. 4 shows bottom member made of synthetic resin, the under surface of which is substantially flat from a short back portion 30 (slightly arcuated upwards) to the so-called front metatarsal arc 29 and proceeds then with a front portion 30*a* having a sharply arcuated shape which forms a front gradually increasing rise up to the tip 31 of the sole, the height of tip 31 above the deambulation plane s depending on the bending radius of this front end portion 30*a* of wooden-shoe 20.

Compared to the foot-support surfaces 14, 14*a* of the prior art shoe of FIG. 3, where the back surface 14 is higher than front surface 14*a*, it is noted that in accordance with the main novel characteristic of the invention, back surface 24 is in this case notably lower than front surface 24*a*.

Because of this difference in the positions of surfaces 24, 24*a*, the subject is induced to move his body angularly backwards, but he actually remains in his upright position as schematically shown in FIG. 5 (with reference to the foot and end part of the leg) in order that he does not lose his balance. The subject is thus obliged to contract the abdominal muscles and straighten the spinal column with stress of the back muscles, as corroborated by the experiments of the Applicant. The result is a gradually incremented contraction of the muscles of the thighs and glutei which are compulsorily carried into action either in a standing or deambulation condition, when such a wooden-shoe 20 is worn intermittently for a sufficiently long time, until the desired result is reached.

The wooden-shoe as shown in FIGS. 4 and 5, wherein a front rise according to the invention is provided, is one representation only and not a limitation for some other embodiments.

In effect, the following considerations are to be made:

I. Not all the persons concerned with such therapy have like height and foot size. Their age may also be different.

II. Not all hyperlordosis is of a like degree at the beginning of the therapy, so that not all the alterations of the load line have a like entity;

III. Not all the persons tolerate a rapid and maximal modification of the static and dynamic trim of the axis of the body; in addition to the appearance of muscular aches due to the carrying into action of the muscular masses which were inactive maybe for some years the subject could show up difficulties in his deambulation and balance, principally at the first time of the therapy. As regards items I and II the Applicant has carried out radiological controls over some tens of patients of the female sex: age 18 to 35; height 154 cm to 182 cm; size of the shoe usually worn 35 to 42.

The subjects have been studied radiologically in their upright position, firstly when they were bare-footed and then by wearing wooden-shoes in accordance with the invention. Different front rises have been tried, these latter being intended as the difference of level between the front support 24*a* and the back support 24 of the foot, as shown in FIGS. 4 and 5.

Through a first selection it was deduced that in a woman having the height of 162 cm and usually wearing shoes of the size 37, the optimal correction was possible by a front rise of 1 cm. This result was chosen as the base to calculate the optimal front rise for subjects usually wearing a different shoe size, according to the following formula:

$$37:1=a:x$$

wherein:

a=size of the shoe usually worn by the patient x=height of the front rise to be chosen for the therapy Thus, for example, when the size of the usually worn shoe is 35:

$$37:1=35:x$$

so that $$x=35:37=0.9 \text{ cm}$$

and in the case of a shoe size 42:

$$x=42:37\mp1.1 \text{ cm}$$

As regards item III., it will be understood that it may be helpful, if not necessary, to have two or more wooden-shoes according, for example, to the embodiment shown in FIGS. 4 and 5, at subject's disposal, such wooden-shoes having a gradually increasing front rise, i.e. a gradually increasing difference between the levels of support planes 24*a* and 24.

As the top member 21, which supports the foot, has preferably an orthopedic shape in order to be more suitable for the user's foot, it may be important to provide only a single top member 21 having such orthopedic shape and two or more bottom members 22 of the type s shown in FIGS. 4 and 5, but easily removable and interchangeable and also solidly connectible to such single top member 21.

According to a further embodiment of the invention, such bottom member 22 is not connected to top member 21 by using a suitable adhesive (as it is made usually) but rather by using conventional means suitable to allow the removal and substitution as desired to carry out the therapy. Differently from the former embodiment, the upper surface of bottom member 22 is connected to the under surface of top member 21 and sufficiently tightened therto, for example by using screws placed in points a, b, c, as shown by short-dashed lines in FIG. 5.

Some other considerations may be of interest:

It was found that the use of a wooden-shoe according to the invention is equivalent to one hour of physical exercises, the results being however much more evident. The toil of remaining in upright position and wearing the wooden-shoe according to the invention, as well as the difficulty of deambulation at the beginning of the therapy by wearing this latter are attenuated in a short time, and after some days the subject may even go up- and downstairs. After having worn such wooden-shoe some few months the musculature of the thighs and glutei will recover their tone. Only at that time the local therapy of cellulitic infiltrates may be put in practice to also avoid a relapse in a short time;

the use of wooden-shoes or sandals having a front rise according to the invention may be important for some other persons who do not show hyperlordosis or lipodystrophia, and nevertheless are in the habit of not standing and not deambulating in a satisfying upright position of their body. The previous therapy, in the course of which the subject is wearing such wooden-shoes, will aim at correcting this abnormal position of the body and even avoiding aggravations while the time is carrying on.

I claim:

1. A wooden-shoe or sandal for treating hyperlordosis and lipodystrophia in the thighs and glutei, which comprises a rigid wooden top member having an upper surface with a generally orthopedic shape for supporting the sole of the foot of the user, and a bottom member forming the sole of the wooden-shoe, said shoe having an opposed heel and tip; the lower surface of said bottom member having a short, slightly upwardly and rearwardly curved back portion, a substantially flat middle portion extending forwardly from said back portion and terminating at the point corresponding to the location on the shoe of the metatarsal arch of the foot of the user, and a front end portion extending forwardly from said middle portion to said tip, said front end portion being sharply curved upwardly and forwardly to provide a gradually increasing rise with respect to the ground from said termination of said middle portion to said tip; said top member providing said upper surface with a rear surface portion correspondingly positioned at the slightly upwardly and rearwardly curved back portion of said bottom member lower surface for supporting the heel of the foot, a front surface portion correspondingly positioned at said front end portion of said bottom member lower surface for supporting the front of the foot and a middle surface portion extending forwardly from said rear surface portion to said front surface portion, said front surface portion being higher than said rear surface portion.

2. The wooden-shoe or sandal according to claim 1, wherein said top and bottom members are integral and are made of wood.

3. The wooden shoe or sandal according to claim 1, wherein said top and bottom members are connected together.

4. The wooden shoe or sandal according to claim 3, wherein both said top and bottom members are made of wood.

5. The wooden shoe or sandal according to claim 3, wherein said top member is made of wood and said bottom member is made of a synthetic resin.

6. The wooden shoe or sandal according to claim 3, wherein said top and bottom members are detachably connected together to permit replacement of said bottom member.

7. A wooden-shoe sandal for treating hyperlordosis and lipodystrophia in the thighs and glutei, which comprises a rigid wooden top member having an upper surface with a generally orthopedic shape for supporting the sole of the foot of the user and a substantially flat lower surface provided with short front and back end portions that are slightly bent upwards with a large bending radius, and a bottom member forming the sole of the wooden-shoe and so shaped that its upper surface is complementary to the lower surface of said top member, said shoe having an opposed heel and tip; the lower surface of said bottom member having a short, slightly upwardly and rearwardly curved back portion, a substantially flat middle portion extending forwardly from said back portion and terminating at the point corresponding to the location on the shoe of the metatarsal arch of the foot of the user, and a front end portion extending forwardly from said middle portion to said tip, said front end portion being sharply curved upwardly and forwardly to provide a gradually increasing rise with respect to the ground from said termination of said middle portion to said tip, said top member providing said upper surface with a rear surface portion correspondingly positioned at the slightly upwardly and rearwardly curved back portion of said bottom member lower surface for supporting the heel of the foot, a front surface portion correspondingly positioned at the slightly upwardly and rearwardly curved back portion of said bottom member lower surface for supporting the front of the foot and a middle surface portion extending forwardly from said rear surface portion to said front surface portion, said front surface portion being higher than said rear surface portion.

8. The wooden shoe or sandal according to claim 7, wherein said top and bottom members are connected together.

9. The wooden shoe or sandal according to claim 8, wherein both said top and bottom members are made of wood.

10. The wooden shoe or sandal according to claim 8, wherein said top member is made of wood and said bottom member is made of a synthetic resin.

11. The wooden shoe or sandal according to claim 8, wherein said top and bottom members are detachably connected together to permit replacement of said bottom member.

* * * * *